US009217443B2

(12) United States Patent
He

(10) Patent No.: US 9,217,443 B2
(45) Date of Patent: Dec. 22, 2015

(54) ENERGY SAVING FAN

(75) Inventor: Pinyan He, Ningbo (CN)

(73) Assignee: Xuelong Group Co., LTD., Ningbo (CN)

( * ) Notice: Subject to any disclaimer, the term of this patent is extended or adjusted under 35 U.S.C. 154(b) by 751 days.

(21) Appl. No.: 13/521,925

(22) PCT Filed: Apr. 2, 2010

(86) PCT No.: PCT/CN2010/000433

§ 371 (c)(1),
(2), (4) Date: Jul. 12, 2012

(87) PCT Pub. No.: WO2011/085524

PCT Pub. Date: Jul. 21, 2011

(65) Prior Publication Data

US 2012/0321467 A1 Dec. 20, 2012

(30) Foreign Application Priority Data

Jan. 12, 2010 (CN) ..... 2010 2 0002134 U
Apr. 2, 2010 (WO) ..... PCT/CN2010/000433

(51) Int. Cl.
*F04D 29/32* (2006.01)
*F04D 29/34* (2006.01)
*F04D 29/38* (2006.01)

(52) U.S. Cl.
CPC ..... *F04D 29/329* (2013.01); *F04D 29/34* (2013.01); *F04D 29/384* (2013.01); *F04D 29/388* (2013.01)

(58) Field of Classification Search
CPC ... F04D 29/325; F04D 29/329; F04D 29/384; F04D 29/386; F04D 29/388; F04D 29/662; F04D 29/26; F04D 29/32; F04D 29/38; F04D 19/00; F04D 19/002; F05D 2240/301; F05D 2260/15
See application file for complete search history.

(56) References Cited

U.S. PATENT DOCUMENTS

| | | | | |
|---|---|---|---|---|
| 6,005,749 | A * | 12/1999 | Ikuta et al. | 360/99.12 |
| 6,375,427 | B1 * | 4/2002 | Williams et al. | 416/169 A |
| 6,908,284 | B2 * | 6/2005 | Adrian | 416/134 R |
| 7,063,507 | B2 * | 6/2006 | Hsieh | 416/144 |
| 7,600,980 | B2 * | 10/2009 | Sato | 416/238 |
| 2002/0034443 | A1 * | 3/2002 | Song | 416/223 R |

* cited by examiner

*Primary Examiner* — Edward Look
*Assistant Examiner* — Juan G Flores
(74) *Attorney, Agent, or Firm* — Marshall A. Lerner; Bradford E. Mattes; Kleinberg & Lerner, LLP.

(57) ABSTRACT

An energy saving fan comprising a pellet (1), a hub (2) connected with the pellet (1) and a plurality of curve shaped blades (3) extended radially outward from the hub (2). The roots (31) of the adjacent blades (3) are connected by a curved shaped connecting part (32) extending from the trailing edge (33) of a previous blade to the leading edge (34) of a subsequent blade. A first reinforcing rib (41) is formed on a windward surface (35) of each blade (3) from a trailing edge corner (331) to the hub (2), a second reinforcing rib (42) is formed on a leeward surface (36) of each blade (3) from a leading edge corner (341) to the hub (2), and a third reinforcing rib (43) is formed on the leeward surface (36) of each blade (3) from the hub (2) to the trailing edge (33). These reinforcing ribs improve the strength of the blade roots and prolong the service life of the blades.

10 Claims, 5 Drawing Sheets

ENERGY SAVING FAN

TECHNICAL FIELD

The present application relates to a cooling fan, in particular to a fan used in an automobile cooling system.

BACKGROUND

The conventional cooling fan generally includes a pallet, a hub and blades; the blades are integrated with the hub through plastic injection molding. For saving material, the thickness of the hub is reduced to minimum thickness; therefore, the hub is relatively thin. When large blades are connected to the hub, the roots of the blades need to be distorted before connecting to the hub. However, such structure easily results to a fracture at the root of the blade. For improving connection strength between the blades and the hub, some solutions have been proposed. For example, the patent application with Publication No. WO2008/141253A1, published on Nov. 20, 2008, discloses a fan structure comprising a hub member, a plurality of blade members extending radially outward from said hub member, a plurality of helical gusset members. The numbers of gusset members correspond to the number of blade members, and each of said gusset members extends from the hub member adjacent to one blade member to the trailing edge of an adjacent blade member. The technical solution of the above application improves the connection strength between the blades and the hub through providing gusset members. Although such gusset members are able to improve the connection strength, such connection structure easily results to stress concentration; thus results to a reduction of the strength of the blade, and fracture of the blade. Meanwhile, such structure can result to a reduction of air quantity and efficiency of the blades.

SUMMARY

The object of present application is to overcome above defects, and to provide an energy saving fan which has high strength, low flowing energy loss, high fan efficiency and low cost.

A high efficiency, energy saving and cost saving fan according to the present application comprising a pellet, a hub connected with the pellet, and a plurality of curve shaped blades extended radially outward from the hub, roots of adjacent blades are connected by a curve shaped connecting part extending from a trailing edge of a previous blade to a leading edge of a subsequent blade, a first reinforcing rib is formed on a windward surface of each said blade from a corner of the trailing edge to the hub, a second reinforcing rib is formed on a leeward surface of each said blade from a corner of the leading edge to the hub, and a third reinforcing rib is formed on the leeward surface of each said blade from the hub to the trailing edge.

According to the present application, the high efficiency, energy saving and cost saving fan also has the following additional technical features:

The first reinforcing rib is connected to the hub along the tendency of the trailing edge of the blade and in the front of the corner.

The second reinforcing rib is connected to the hub along the tendency of the leading edge of the blade and in the front of the corner.

The third reinforced rib and a connecting point of the hub are close to the leading edge of the blade, and extend along air-intake direction.

The third reinforcing rib and the connecting point of the hub are located at ⅗ to ⅘ of the blade's projection width.

Multiple circular holes, which are suitable for receiving balance adjustment steel balls, are provided on the hub along thickness direction.

The pellet has a stretching structure through one-step molding, and the edge thereof is integrated with the hub by plastic injection molding.

The pellet has a plain structure, and the edge thereof is integrated with the hub by plastic injection molding.

Each said blade includes a body, a root and an end, the body of the blade is equidistantly divided into five segments to form total of six cross-sections, from the cross-section close to the root to the cross-section close to end, the respective angles between horizontal level and chord of each cross-section are: 40.5°-42.5°, 39.5°-41.5°, 37.8°-39.9°, 36.3°-38.3°, 34.9°-36.9° and 33.8°-36°.

The respective heights of the first, second and third reinforcing ribs are 1.5 mm-5.0 mm.

Compared with the prior art, the high efficiency, energy saving and cost saving fan according to the present application has the following advantages. Firstly, reinforcing ribs are provided respectively on the roots of the windward surface and the leeward surface of the blade, so that the strength of the blade's root is enhanced, the blade is not easy to break, and the blade's service life is improved. Secondly, each adjacent blade is connected by a curve shaped connecting part, and the blades are connected to the hub, so that the connection strength between the blade and the hub is improved. In addition, the curve shaped connecting part reduces the influence to inlet airflow. Thirdly, multiple circular holes are provided on the hub, steel balls can be provided in various holes according to the blade balance adjustment requirements. In order to reach the balance adjustment goal, standard steel balls with the lowest costs can be used to adjust balance. Steel balls are standard parts, their costs are the lowest, and several steel balls can be placed at once according to balance requirements; and the steel balls can be press-mounted in one step since the steel balls will not jump out even with pressure. The conventional balance adjustment methods, such as using balance block, inserting piece, rivet, bolt, borehole, etc., have low operational efficiency, wherein some methods require non-standard parts, some methods have high cost due to low procurement volume, and all conventional balance adjustment methods cannot perform press-mounting in one step.

DETAILED DESCRIPTION

Figure 1:
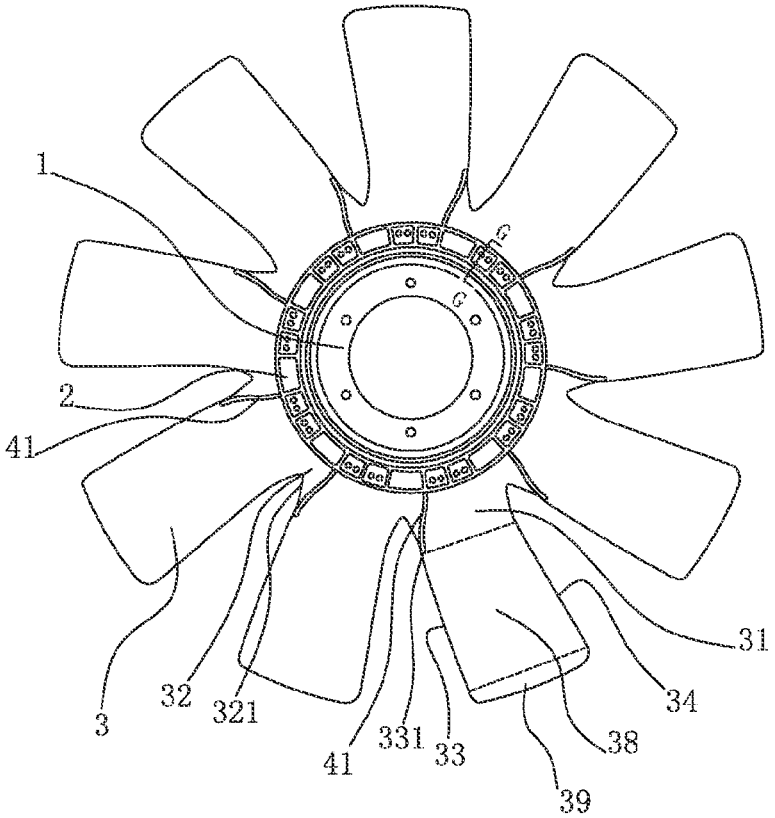
FIG. 1 is a front view of the present application.
Figure 2:
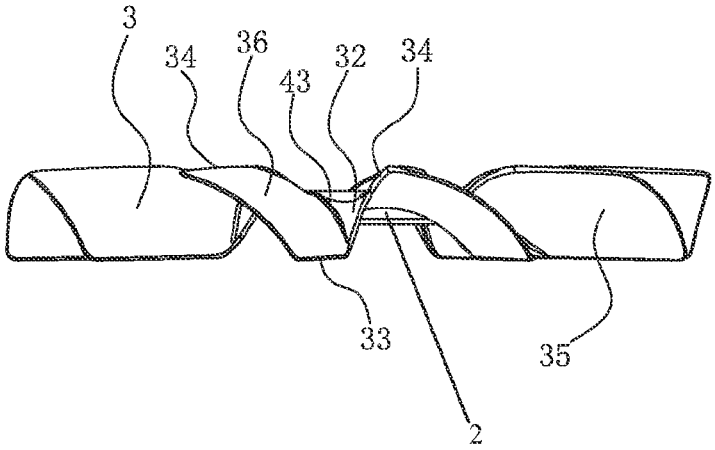
FIG. 2 is a top view of the present application.

With reference to FIGS. 1-6, the high efficiency, energy saving and cost saving fan disclosed in one embodiment of the present application comprises a pellet 1, a hub 2 connected with the pellet 1, and a plurality of curve shaped blades 3 extended radially outward from the hub 2. Roots 31 of adjacent blades 3 are connected by a curve shaped connecting part 32 extending from a trailing edge 33 of a previous blade to a leading edge 34 of a subsequent blade. A first reinforcing rib 41 is formed on a windward surface (concave surface) 35 of each blade 3 from a corner 331 of the trailing edge 33 to the hub 2, a second reinforcing rib 42 is formed on a leeward surface (convex surface) 36 of each blade 3 from a corner 341 of the leading edge 34 to the hub 2, and a third reinforcing rib 43 is formed on the leeward surface (convex surface) 36 of each blade 3 from the hub 2 to the trailing edge 33. The windward surface 35 is the concave surface of the blade, and the leeward surface 36 is the convex surface of the blade.

The pallet 1 in the present application is generally formed by metal and used for connecting with a driving mechanism; thus the pallet 1 is provided with a plurality of fixing holes for installation. The hub 2 is integrated with the blade 3. The pallet 1 generally is integrated with the hub 2 through plastic injection molding during manufacturing. The thickness of the hub 2 is less than width of the blade 3, so as to benefit the connection between the pallet 1 and the driving mechanism. When the root 31 of the blade 3 are connected to the hub, the root 31 need to change its shape to be suitable to the thickness of the hub 2 because the thickness of the hub 2 is less than width of the blade 3. However, the connection strength between the blade 3 and the hub 2 is reduced after the change of shapes. In order to enhance the connection strength of the root 31 of the blade 3, roots 31 of adjacent blades 3 are connected by a curve shaped connecting part, so that all the blades 3 form an entirety, the connection area between roots 31 and the hub 2 is increased and connection strength is improved.

The blade in the present application includes a body 38, a root 31 and an end 39. The body 38 and the root 31 form a corner at junction, so that the trailing edge 33 of a blade 3 is connected with the leading edge 34 of adjacent blade 3 via an outer edge 321 of the connecting part 32. When the above-said three parts are connected together, the orthographic projection of the combination of the three parts is approximate to a U-shape or a V-shape.

In the present application, a reinforcing rib is provided on the root 31 of each blade 3, so that the strength of the root 31 of each blade 3 is enhanced, resulting the blade 3 not easy to break, and improving the service life of the blade.

Figure 5:
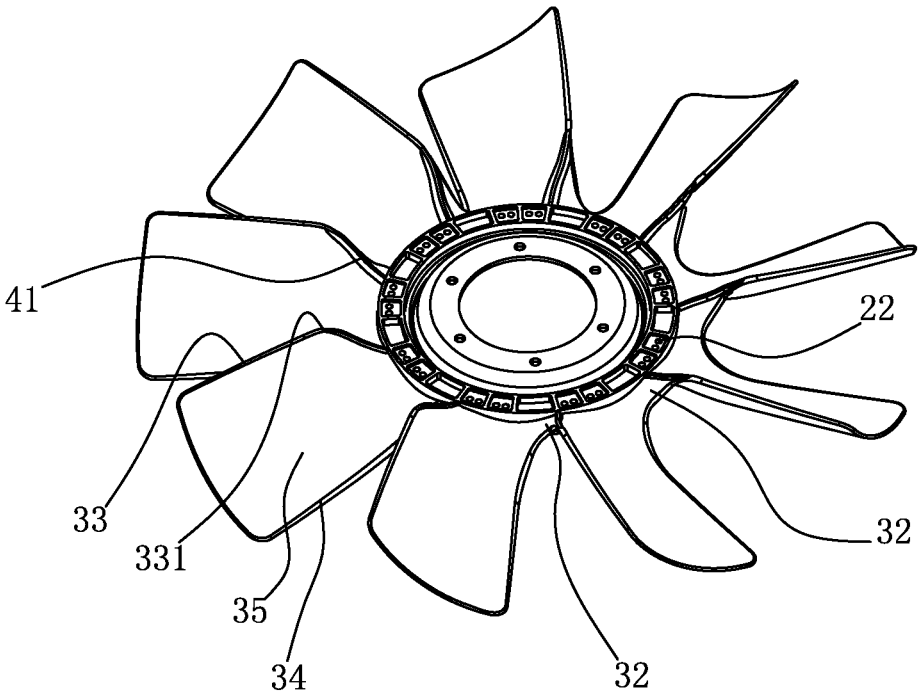
FIG. 5 is a front perspective view of the present application.

With reference to FIG. 1 and FIG. 5, in the above embodiment of the present application, the first reinforcing rib 41 is connected to the hub 2 along the tendency of the trailing edge 33 of the blade 3 and in the front of the corner 331. That is, the first reinforcing rib 41 is connected with the trailing edge 33 of the body 38 of the blade 3, so that the first reinforcing rib 41 and the trailing edge 33 form an integrated structure. The first reinforcing rib 41 not only enhances the strength of the blade 3, but also improves the performance of windward surface (concave surface) of the blade 3.

Figure 3:
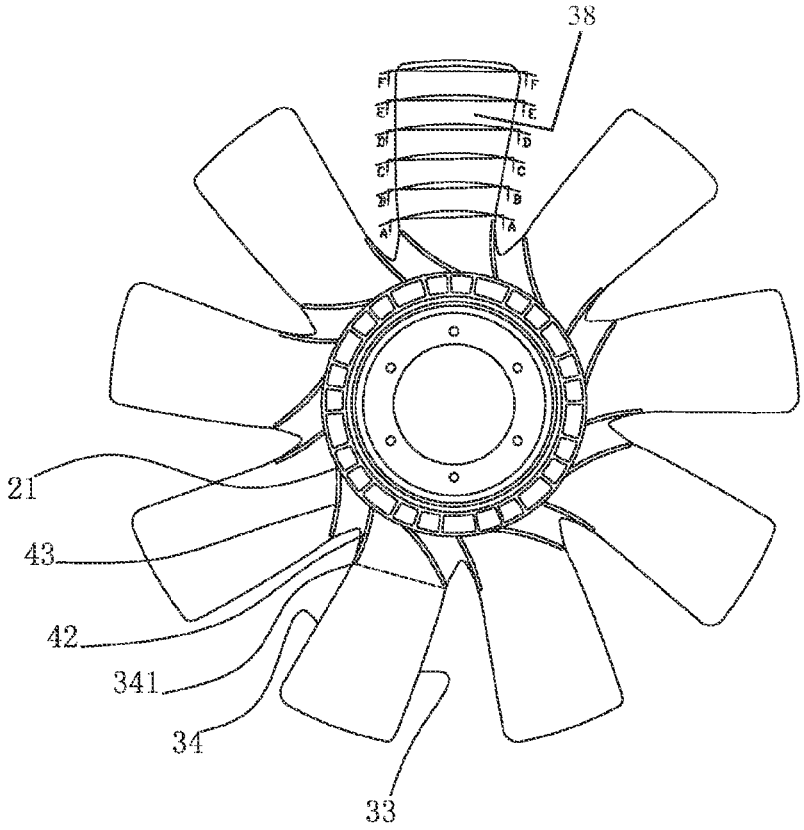
FIG. 3 is a rear view of the present application.
Figure 4:
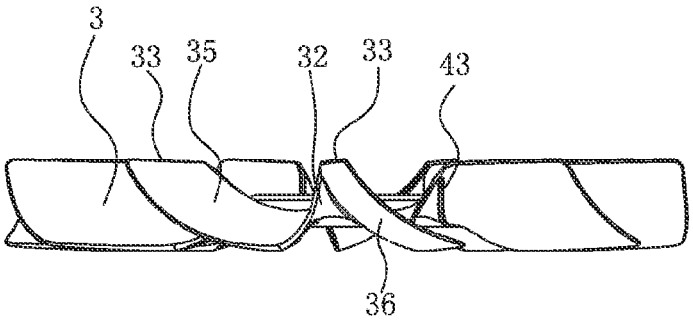
FIG. 4 is a right view of the present application.
Figure 6:
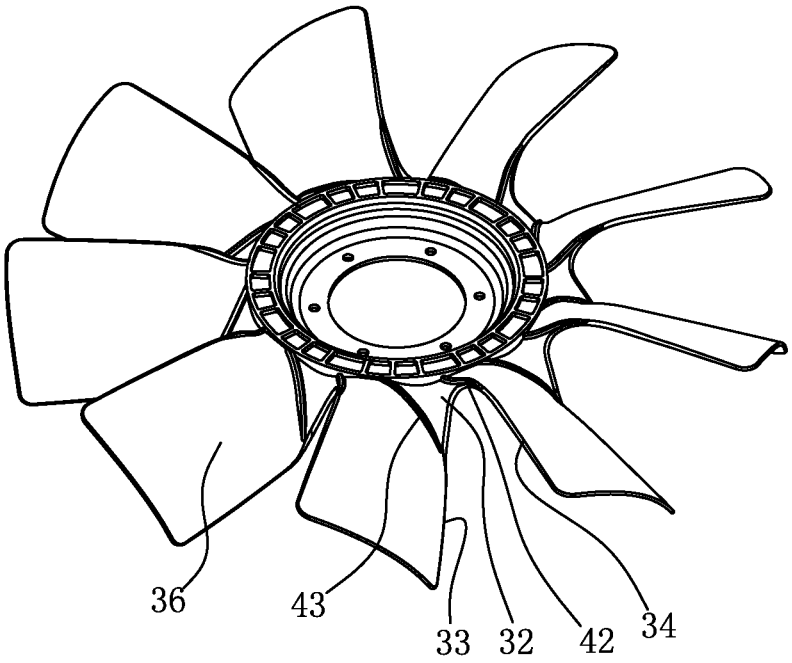
FIG. 6 is a rear perspective view of the present application.
Figure 7:
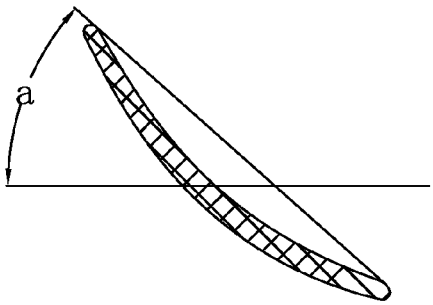
FIG. 7 is a cross-sectional view taken along line A-A in FIG. 3.
Figure 10:
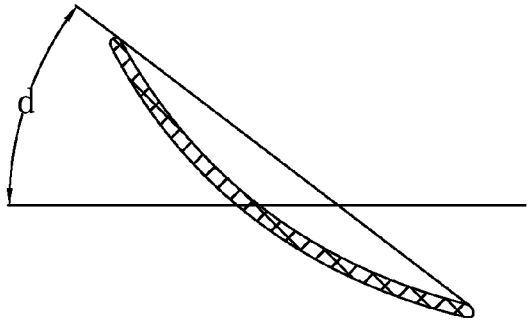
FIG. 10 is a cross-sectional view taken along line D-D in FIG. 3.
Figure 8:
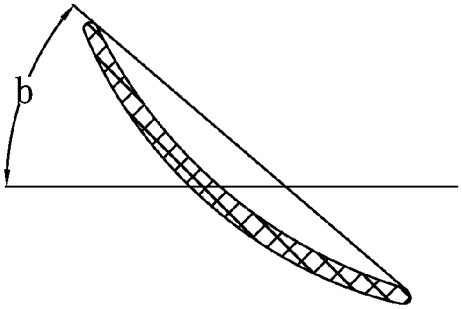
FIG. 8 is a cross-sectional view taken along line B-B in FIG. 3.
Figure 11:
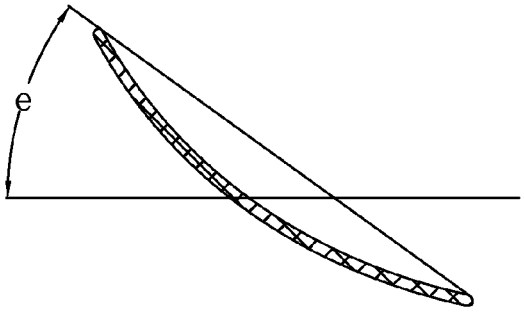
FIG. 11 is a cross-sectional view taken along line E-E in FIG. 3.
Figure 9:
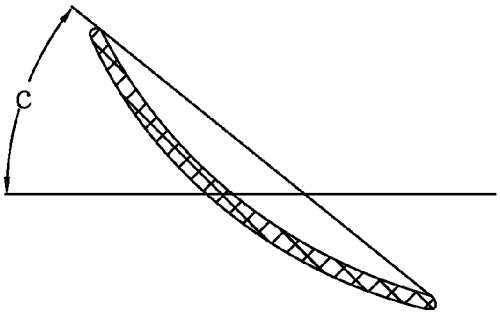
FIG. 9 is a cross-sectional view taken along line C-C in FIG. 3.
Figure 12:
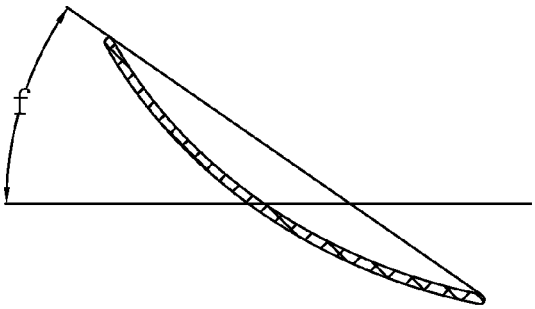
FIG. 12 is a cross-sectional view taken along line F-F in FIG. 3.

With reference to FIG. 3 and FIG. 6, in the above embodiment of the present application, the second reinforcing rib 42 is connected to the hub 2 along the tendency of the leading edge 34 of the blade 3 and in the front of the corner 341. That is, the second reinforcing rib 42 is connected with the leading edge 34 of the body 38 of the blade 3, so that the second reinforcing rib 42 and the leading edge 34 form an integrated structure. The second reinforcing rib 42 not only enhances the strength of the blade 3, but also improves the performance of leeward surface (convex surface) of the blade 3.

With reference to FIG. 3 and FIG. 6, in the above embodiment of the present application, the third reinforcing rib 43 and a connecting point 21 of the hub 2 are close to the leading edge 34 of the blade 3, and extend along the air-intake direction. The third reinforcing rib 43 and the connecting point 21 of the hub 2 are located at ⅗ to ⅘ position of the blade's projection width. In this embodiment, the position is at ⅔ of the blade's projection width. The third reinforcing rib 43 is formed on the leeward surface (convex surface) and its tendency is substantially along airflow direction, so it cannot influence the airflow.

Figure 13:
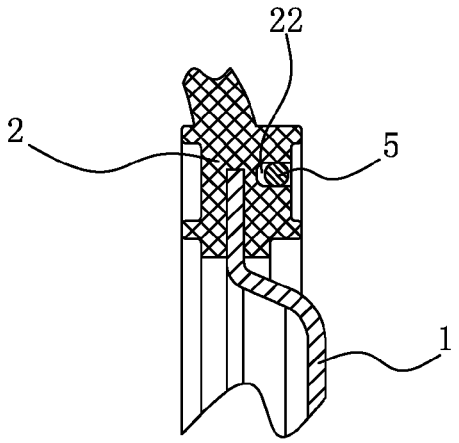
FIG. 13 is a cross-sectional view taken along line G-G in FIG. 1.
Figure 15:
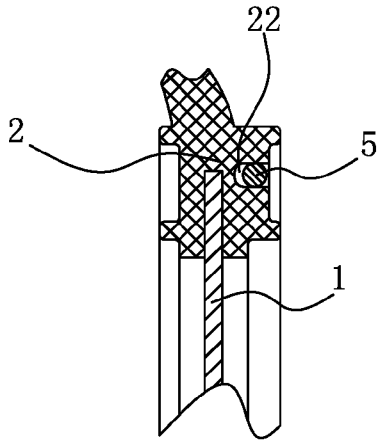
FIG. 15 is a cross-sectional view along H-H in FIG. 14.
Figure 14:
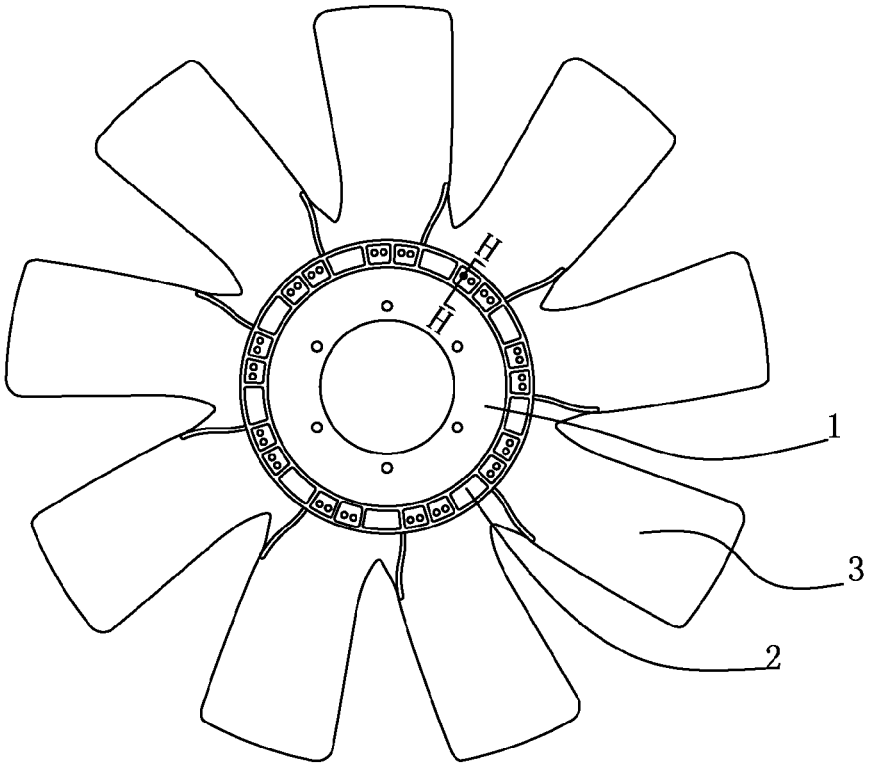
FIG. 14 is a front view of another embodiment of the present application.

With reference to FIG. 1 and FIG. 13, in the above embodiment of the present application, multiple circular holes, which are suitable for receiving balance adjustment steel balls 5, are provided on the hub 2 along thickness direction. The circular holes form a circle around the hub 2. The steel balls can be set in various holes 22 according to the balance requirements, to resolve fan balance issue during manufacture. Standard steel balls with the lowest costs can be used to adjust balance. Since steel balls are standard parts, their costs are lowest, and several steel balls can be placed at once according to the balance requirements; the steel balls can be press-mounted in one step since the steel balls will not jump out even under pressure. The conventional balance adjustment methods, such as using balance block, inserting piece, rivet, bolt, borehole etc., have low operational efficiency, some methods require non-standard parts, some methods have high cost due to low procurement volume, and all conventional balance adjustment methods cannot perform press-mounting in one step.

With reference to FIG. 6 and FIG. 13, in the above embodiment of the present application, the pellet 1 has a stretching structure through one-step molding, the depth of stretching can be adjusted according to installation requirements, and the edge of the pellet 1 is integrated with the hub by plastic injection molding. Different stretching structure can be provided so that the installation position can be adjusted without redesigning blades, which benefit to machining of blades.

With reference to FIG. 3, in the above embodiment of the present application, the body 38 of the blade 3 is equidistantly divided into five segments to form a total of six cross-sections. From the cross-section close to the root to the cross-section close to end, the respective angles between horizontal level and chord of each cross-section are: 40.5°-42.5°, 39.5°-41.5°, 37.8°-39.9°, 36.3°-38.3°, 349°-36.9° and 33.8°-36°. In the above embodiment of the present application, the respective positions of the six cross-sections are shown as the section line in FIG. 3, i.e., from A-A section line to F-F section line. With reference to FIGS. 7-12, the respective angles between horizontal level and chord for each position are as follows: a is 41.5°, b is 40.5°, c is 38.5°, d is 37°, e is 35.5°, f is 34.5°. Blade having such shape has better performance, and can maximize flow, power consumption and efficiency.

With reference to FIG. 5 and FIG. 6, in the above embodiment of the present application, the respective heights of the first reinforcing rib 41, the second reinforcing rib 42 and the third reinforcing rib 43 are 1.5 mm-5.0 mm. In this embodiment, the height is 3.5 mm. Such reinforcing ribs can meet the blade strength requirements better, and enhance the strength of the blade 3 so that the blade 3 cannot easily break.

With reference to FIGS. 5 and 6, in another embodiment of the present application, the pellet has a plain structure, and its edge is integrated with the hub 2 by plastic injection molding.

The fan described in the present application can be a suction fan, and can also be an exhaust fan.

The invention claimed is:

1. A high efficiency, energy saving and cost saving fan comprising a pellet, a hub connected with the pellet, and a plurality of curve shaped blades extended radially outward from the hub, the hub having a predetermined thickness, characterized in that:

roots of adjacent blades are connected together by a curve shaped connecting part extending from a trailing edge of a previous blade to a leading edge of a subsequent blade in such a manner that the curve shaped connecting part extends across at least a portion of the thickness of the hub, a first reinforcing rib is formed on a windward surface of each said blade from a corner of the trailing edge to the hub, a second reinforcing rib is formed on a leeward surface of each said blade from a corner of the leading edge to the hub, and a third reinforcing rib is formed on the leeward surface of each said blade from the hub to the trailing edge.

2. A high efficiency, energy saving and cost saving fan according to claim 1, characterized in that:

the first reinforcing rib is connected to the hub along the tendency of the trailing edge of the blade and in the front of the corner.

3. A high efficiency, energy saving and cost saving fan according to claim 1, characterized in that:

the second reinforcing rib is connected to the hub along the tendency of the leading edge of the blade and in the front of the corner.

4. A high efficiency, energy saving and cost saving fan according to claim 1, characterized in that:

the third reinforcing rib and a connecting point of the hub are close to the leading edge of the blade, and extend along the air-intake direction.

5. A high efficiency, energy saving and cost saving fan according to claim 4, characterized in that:

the third reinforcing rib and the connecting point of the hub are located at ⅗ to ⅘ of the blade's projection width.

6. A high efficiency, energy saving and cost saving fan according to claim 1, 2, 3 or 4, characterized in that:

multiple circular holes, which are suitable for receiving balance adjustment steel balls, are provided on the hub along thickness direction.

7. A high efficiency, energy saving and cost saving fan according to claim 1, 2, 3 or 4, characterized in that:

the pellet has a stretching structure, and the edge thereof is integrated with the hub by plastic injection molding.

8. A high efficiency, energy saving and cost saving fan according to claim 1, 2, 3 or 4, characterized in that:

the pellet has a plain structure, and the edge thereof is integrated with the hub by plastic injection molding.

9. A high efficiency, energy saving and cost saving fan according to claim 1, 2, 3 or 4, characterized in that:

each said blade includes a body, a root and an end, the body of the blade is equidistantly divided into five segments to form total of six cross-sections, from the cross-section close to the root to the cross-section close to end, the respective angles between horizontal level and chord of each cross-section are: 40.5°-42.5°, 39.5°-41.5°, 37.8°-39.9°, 36.3°-38.3°, 34.9°-36.9° and 33.8°-36°.

10. A high efficiency, energy saving and cost saving fan according to claim 1, 2, 3 or 4, characterized in that:

the respective heights of the first, second and third reinforcing ribs are 1.5 mm-5.0 mm.

* * * * *